US007401454B2

(12) United States Patent
Kaden

(10) Patent No.: US 7,401,454 B2
(45) Date of Patent: Jul. 22, 2008

(54) SADDLE FITTING SYSTEM AND METHOD

(76) Inventor: David Graham Kaden, 8267 Bosque Rd., Canutillo, TX (US) 79835

( * ) Notice: Subject to any disclaimer, the term of this patent is extended or adjusted under 35 U.S.C. 154(b) by 372 days.

(21) Appl. No.: 11/373,609

(22) Filed: Mar. 10, 2006

(65) Prior Publication Data

US 2007/0209332 A1 Sep. 13, 2007

Related U.S. Application Data

(60) Provisional application No. 60/660,478, filed on Mar. 10, 2005.

(51) Int. Cl.
*B68C 1/04* (2006.01)
*B68C 1/02* (2006.01)

(52) U.S. Cl. ..... 54/44.3; 54/44.5; 54/44.7

(58) Field of Classification Search ..... 54/44.1, 54/44.3, 44.5, 44.7, 66
See application file for complete search history.

(56) References Cited

U.S. PATENT DOCUMENTS 344,828 A * 7/1886 Hake ..... 54/44.5
4,860,524 A 8/1989 Dumoulin et al. ..... 54/44.7
5,375,397 A 12/1994 Ferrand et al. ..... 54/66
6,125,616 A * 10/2000 Brown ..... 54/66
6,263,647 B1 7/2001 Walkley ..... 54/44.1
6,334,262 B1 1/2002 Ferrand ..... 33/511
6,615,568 B1 9/2003 Roskies ..... 54/66
6,920,743 B2 * 7/2005 Harrison ..... 54/44.7
2007/0137148 A1 * 6/2007 Foster ..... 54/44.5

* cited by examiner

*Primary Examiner*—Rob Swiatek
(74) *Attorney, Agent, or Firm*—Harold L. Marquis; George M. Thomas; James W. Kayden

(57) ABSTRACT

A method of customizing a saddle to fit the back of a particular horse by using shims of various shapes and sizes between the underside of the saddle and pad. These shims are attached to the underside of the saddle and to the pad by a hook and loop fastening system. Different types molding or rebounding pads may be used. The rebounding pads are useful to allow the interchange of saddles between different horses while achieving a perfect fit on each horse.

20 Claims, 4 Drawing Sheets

SADDLE FITTING SYSTEM AND METHOD

CROSS-REFERENCE TO RELATED APPLICATION

This application claims priority to U.S. provisional application entitled, "Saddle Fitting System, Method and Apparatus," having Ser. No. 60/660,478, filed Mar. 10, 2005, which is entirely incorporated herein by reference.

TECHNICAL FIELD

The present invention is generally related to fitting saddles to horses using various types of shims attached to a pad and the bar of a saddle tree by a hook and loop fastening system.

BACKGROUND OF THE INVENTION

Early saddles lacked stirrups and therefore had several shortcomings. For example, with a saddle with no stirrups a rider had to use his hands and grip with his legs to stay on the horse while moving at fast speeds as in hunting or battle. In addition, the rider had his full weight applied through his torso and buttocks onto the horse's back and with the weight being concentrated directly under seat made riding uncomfortable for rider and horse. As a horse galloped or trotted, the rider could not effectively separate his groin and buttocks from the horse's back, except by bouncing from the movement of horse, and this bouncing intensified the discomfort in contact areas.

The introduction of stirrups helped alleviate some of the aforementioned problems in that the rider could more easily brace himself by exerting force on the stirrups. Consequently, his hands were more free to hunt or use weapons or otherwise control the horse. Furthermore, he could stand on the stirrups to separate his torso from the bouncing of the horse's back in motion.

The introduction of the stirrup however, required a rigid frame or "saddle tree" for anchoring the stirrups straps. For example, in order to suspend the weight of a standing rider, the stirrups must be securely attached and supported. In addition the pressure resulting from this weight needed to be distributed over a large surface area to avoid soreness and tissue damage to the horse's back This need for a rigid saddle tree to distribute the weight of rider, whether standing or sitting, made a close fit of the saddle and associated tree important for durability and health of the horse. When the tree did not fit evenly throughout its frame it would concentrate the pressure where it did contact the horse and this resulting concentration could inhibit or even stop blood flow to skin and muscles and bone under the saddle causing permanent damage to the back of the horse.

Attempts to fit a rigid tree to specific horses presented problems in that the same tree could not be used on different horses and because padding is traditionally added under a tree once it has been selected for use on a specific horse and padding changes the size and shape of a horse's back under the tree, the fit prior to addition of padding was not equal to the fit visualized before padding was applied. This led to development of trees with padding build in as seen on what are commonly termed "English" saddles.

In addition, not only do different breeds of horses vary in shape and size but animals within the same breed vary in size and shape, and an individual horse may vary from time to time, resulting from changes in age, diet and exercise.

Numerous attempts to create a saddle with adjustable fit have been made to adjust contact in limited ways. They use systems which either have flexible members which move away from pressure resulting in pressure concentrations at the remaining points of suspension or adjustable trees which require tools and do not make allowances for padding as traditionally applied under rigid tree saddles, the addition of which often causes the fit to become too tight and pressure areas to develop.

SUMMARY OF THE INVENTION

The invention relates to a method and apparatus for customizing a riding saddle to precisely fit a particular horse. In addition, the fit may be modified to fit the horse should his shape change from exercise, diet or age and the saddle fit may be modified for use on different horses, all without tools. Unlike traditional western saddles whose fit is hidden under fleece attached to the underside of saddle and whose fit is further altered by the addition of pads and blankets, the customized padding is built into the system described herein. The saddle of this invention is constructed in such a way that the fit is easy to visually inspect and modify as required.

This invention uses a plurality of shims and a pad that are interconnected by a hook and loop fastening system, such as the one sold under the registered trademark VELCRO®, to interconnect the shims, pad and the bars of the saddle tree. The shims may be of various sizes, shapes and thicknesses and may be flat, wedge-shaped, or of another configuration and used in order to distribute the pressure of the saddle more uniformly on the back of the horse. The hook and loop fastening system connects the top face of the shims to the bars of the saddle tree. The hook and loop fastening system also interconnects the bottom face of the shims with the pad which is placed on the back of the horse. The hook and loop fastening system is especially suitable because it permits the easy removal of the shims and pad from the saddle.

The method also allows the rider or other person to independently adjust the width, the arch and angle of shims contacting the back of the horse so as to make uniform contact along the underside of saddle, thus avoiding pressure concentrations resulting from improper fit which lead to tissue damage and soreness in the horse. In addition, the invention covers the use of pads that have a characteristic that "molds" or permanently conforms to the contour of the horse which is desirable in the case of a saddle that is customized to only be used on one horse. A pad material that rebounds each time it is compressed and has a memory to return to its original thickness is suitable as a platform for use on different horses. Shims may also be used with the molding pad. In addition the invention makes use of pad materials which attach by means of VELCRO® to the rigid tree of differing characteristics to permit selection of a material that "molds" or otherwise permanently conforms to the horse or selection of a pad material which rebounds from its compression and returns to original thickness so as to be suitable as a platform for use on a different horse.

In addition, the invention provides for attachment for stirrup straps in varying positions fore and aft so as to facilitate different riding positions preferred by riders riding different breeds, at different speeds, and using different associated body positions of the rider to accommodate the different types of riding.

The foregoing outlines the features of the present invention in order that the detailed description of the invention that follows may be better understood. Additional features and advantages of the invention will be described herein which form the subject of the claims of the invention.

BRIEF DESCRIPTION OF THE DRAWINGS

Many aspects of the invention can be better understood with reference to the following drawings. The components in the drawings are not necessarily to scale, emphasis instead being placed upon clearly illustrating the principles of the present invention. Moreover, in the drawings, like reference numerals designate corresponding parts throughout the several views.

DETAILED DESCRIPTION OF THE PREFERRED EMBODIMENT

The invention relates to a method and apparatus for customizing a riding saddle to substantially or precisely fit a horse, and adjusting the fit of the saddle for use on different horses having various body shapes or body types. In one embodiment, the method comprises a step of inserting under the saddle shaped shims which fill voids between a rigid tree and neoprene rubber pads which rest on the back of the horse. This embodiment allows the horse rider to visually inspect the compatibility of the saddle and the shape of a given back for a particular horse. The method also allows the horse rider or other person to independently adjust the width, the arch and the angle of contact so as to make a substantially uniform contact along the underside of the saddle, thus avoiding pressure concentrations which lead to soreness in the back of the horse.

A riding saddle has a traditional rigid frame called a saddle tree. The tree supports the seat, the rear of which is termed a cantle and front of which is called a pommel or fork. The seat rests on spaced opposed members, called bars, which transmit the weight of rider and saddle on the horse. The tree may be made of wood, plastic, nylon or other composite material and to which the underside of the bars are attached shims of varying shape and thickness using VELCRO® and/or similar securable detachable, replaceable attachment material and a pad, preferably made of neoprene.

Figure 1:
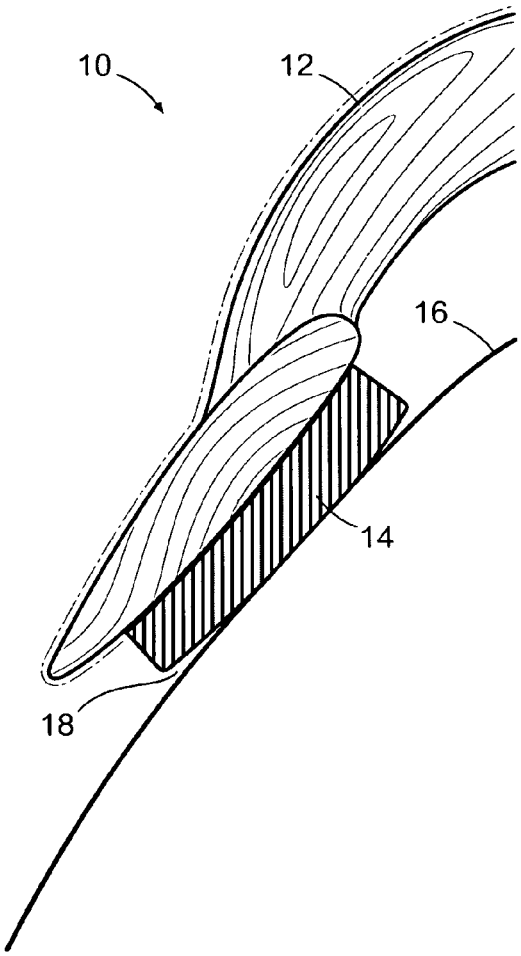
FIG. 1 is a front view of the right side of a horse with a saddle tree on the horse which shows the installation of a ⅝ inch neoprene pad installed in an upper position for a 6 inch overall gullet width at the top of the contact of the pad with a horse.

The numeral 10 represents a saddle tree 12 with a neoprene pad 14 on the back of a horse in FIG. 1. The neoprene pad 14 in FIG. 1 is installed in the upper position to achieve a 6 inch overall gullet width at the top of the contact of the pad with the horse and the saddle tree. It will be noticed that with this relatively rigid neoprene pad 14 a gap 18 exists between the horse 16 and the bottom of the neoprene pad 14. In this case the weight of the saddle and any rider is not distributed uniformly along the back of the horse because of the gap 18.

Figure 2:
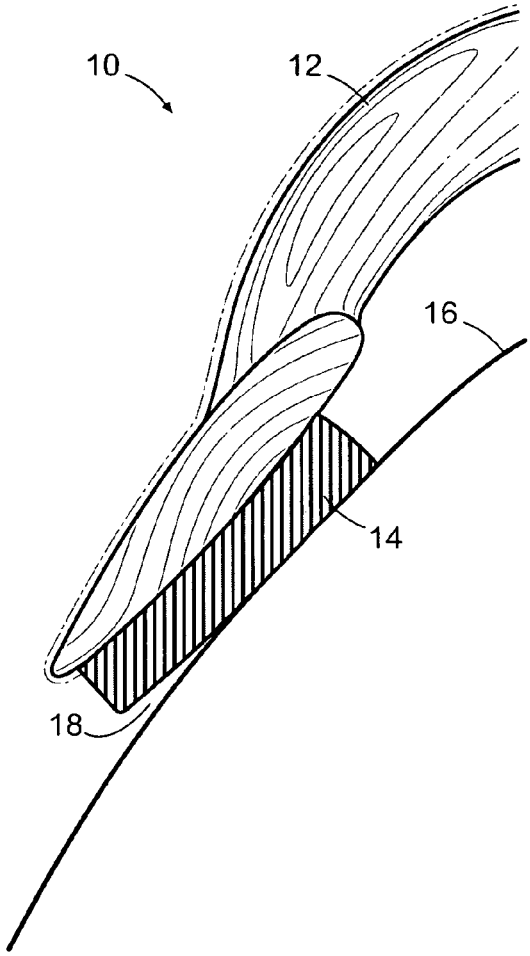
FIG. 2 is a front view of the right side of a horse with a saddle tree on the horse. In this case the ⅝ inch neoprene pad is installed in the lower position for a 7 inch overall gullet width at the top of the contact of the pad with the horse.

FIG. 2 is a front view of the right side of the horse with a saddle tree on the horse. The pad is installed in the lower position and there is a 7 inch overall gullet width at the top of the contact of the pad with the horse 16. Also in this case a gap 18 exists between the bottom of the pad 14 and the back of the horse 16.

Figure 3:
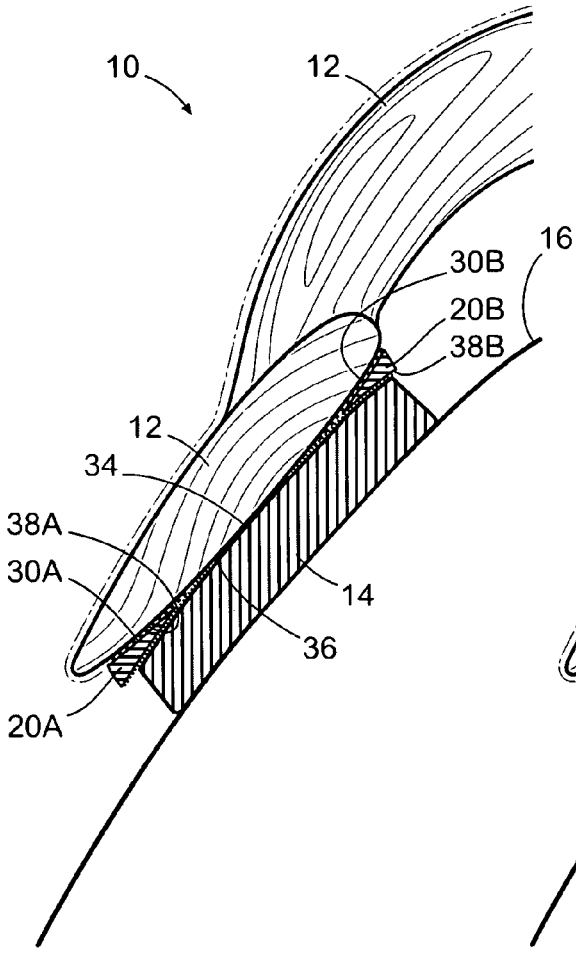
FIG. 3 is a front view of the right side of a horse with a saddle tree on the horse which shows the installation of a ⅝ inch neoprene pad installed in the upper position with ⅜ inch wedge-shaped shim. ⅜ inch wedge-shaped shims are installed longitudinally to correct the lower bar pad angle.

FIG. 3 is a front view of the right side of the horse with a saddle tree on the horse. In this case a ⅝ inch neoprene pad 14 is installed in the upper position with ⅜ inch wedge-shaped shims 20A and 20B installed longitudinally to correct the lower pad angle to achieve contact between the horse 16 and the pad 14. This demonstrates the adjustable angle of the pad 14 with enhanced contact. It will be noticed that the weight of the saddle with the rider is uniformly distributed along the back of the horse 16. These shims 20A and 20B can be constructed out of any suitable rigid material such as leather, wood, etc.

The neoprene pad 14 and wedge-shaped shims 20A and B are held in position by hook and loop fastening systems. Hook and loop fastening systems 30A and 30B hold the wedge-shaped shims 20A and 20B to the saddle tree 12. The underside of the saddle tree 12 has either a hook or a loop section of a fastening system attached to it. These sections may be attached by glue, staple, tacks, or other mechanical means to the underside of the saddle tree 12. These sections would normally be part of a single section under the entire tree 12. Another section of the hook and loop system is attached to the top face of each shim 20A and 20B. The numerals 30A and 30B represent the entire hook and loop system, of which one section is attached to the underside of tree 12 to the top face of shims 20A and 20B. It should be realized that the hook of the fastening system may be attached to the underside of the saddle tree 12 and the loop be attached to the top face of the shim 20A and B or vice versa. The hook and loop system is typically located on a piece of flexible material which would be attached to the top face of the shim 20A and B and to the underside of the saddle tree 12 by glue or mechanical means.

In a similar fashion a hook and loop fastening system 38A and 38B is interposed between the bottom face of the shims 20A and 20B and the top face of the neoprene pad 14. The hook and loop fastening system 38A and 38B between the pad and the shim can also be on separate pieces of material attached to the pad or to the shim. These shims allow irregular arches to be precisely filled with ease by appropriately selecting one or more shims which are shaped to match the void or empty space existing between the neoprene pad 14 and the back of the horse 16. A section of a hook and loop fastening system 38A and 38B is attached to the bottom face of shims 20A and B. A corresponding section is attached to the top face of the neoprene pad 14.

A riding saddle may be constructed or used that allows the width to be adjusted by the position of the neoprene pads 14 contacting the back of the horse 16. The pads 14 can be lowered to make the width wider or raised to make the width narrower by changing the point of attachment of a given thickness of pads. The riding saddle may now allow the rider to adjust the arch (or "rock") of the neoprene pads 14 contacting the back by installing shims 20A and B of varying thicknesses to accommodate the curve or dip in the back of a given horse so as to minimize pressure concentrations associated with saddles that span a void in the center of back a conditioning known as "bridging" in the saddle field.

Figure 4:
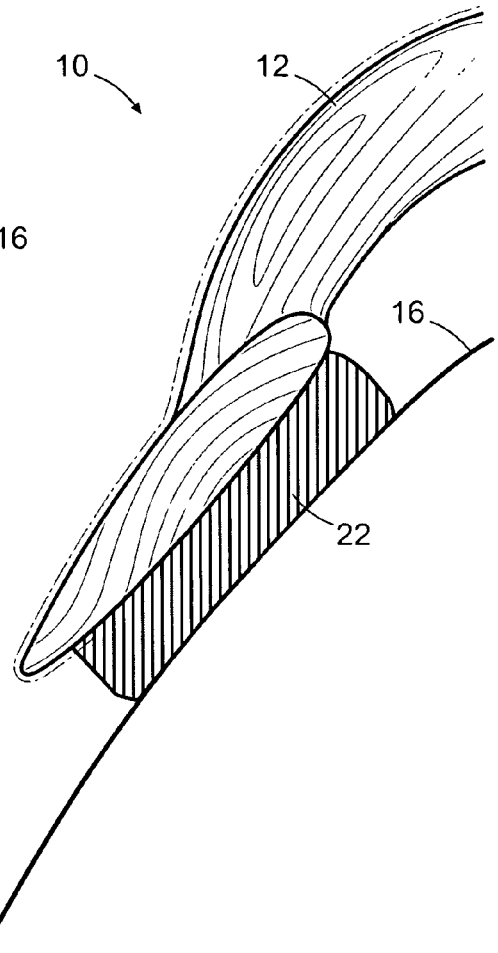
FIG. 4 is a front view of the right side of the horse with a saddle tree on the horse which shows the installation of a one inch non-rebounding neoprene pad.

FIG. 4 is a front view of the right side of a horse with a saddle tree which has a one inch soft non-rebounding neoprene pad 22, commonly referred to as molding pads. This pad compresses to form fit the horse creating the enhanced contact with the horse.

Figure 5:
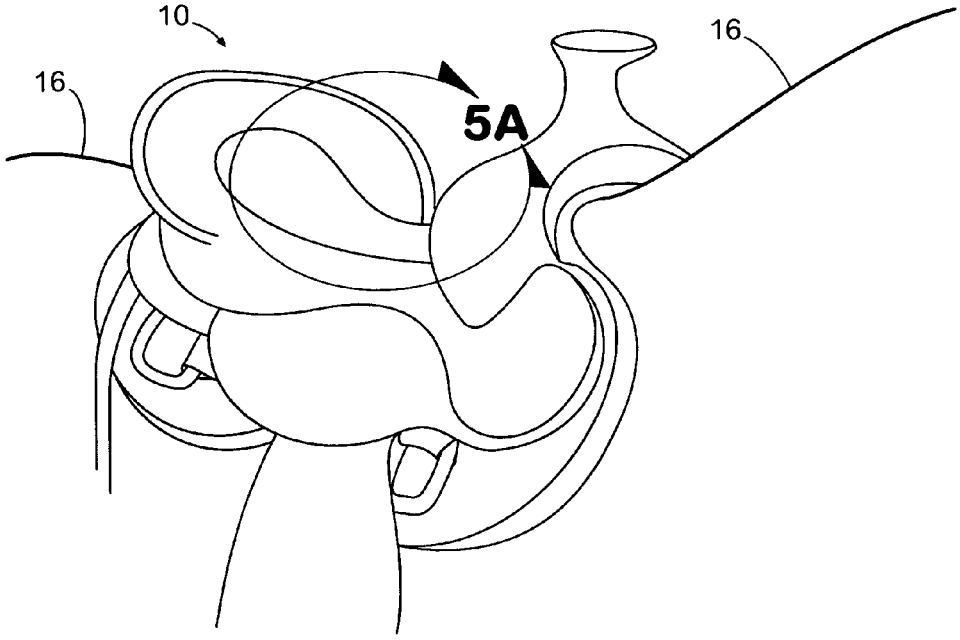
FIG. 5 is a perspective side view of a saddle on a horse.
Figure 5A:
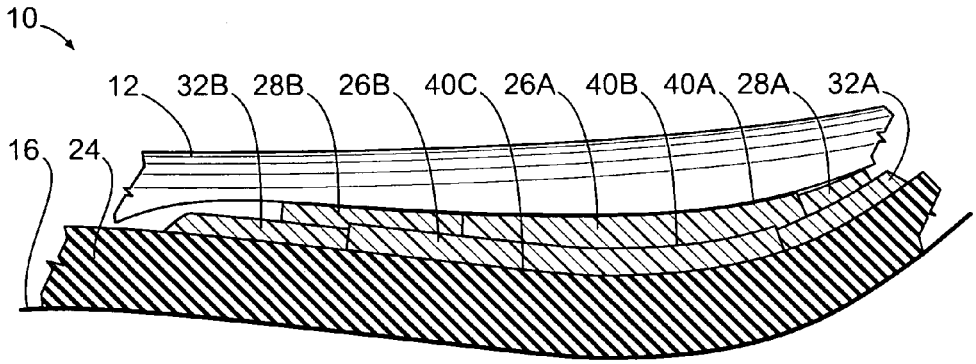
FIG. 5A is a side view of a cross section of a saddle tree with a ⅝ inch neoprene pad with ¼ and ⅛ inch flat shims installed in layers between the pad and the saddle tree.

FIG. 5 is a perspective side view of a saddle on a horse. FIG. 5A is a side view of a cross section of a saddle tree with a ⅝ inch pad and ¼ and ⅛ shims installed in layers to change the arc so as to enhance contact between the pad and the horse and conform to the dip in the horse that exists behind the withers of the horse. In this case, ¼ inch shims 26A and 26B are installed in layers using the hook and loop fastening system illustrated in FIG. 3. In this case, ⅛ inch shims 28A, 28B, 32A and 32B are also used to ensure the proper contact. A hook and loop fastening system 40A is used between the underside of the saddle tree 12 and the first layer of shims 26A, 28A and 28B. A hook and loop fastening system 40B is used between the first layer of shims 26A, 28A and 28B and the second layer of shims 26B, 32A and 32B with a hook and loop fastening system 40C used between this layer and the pad 24.

Figure 6:
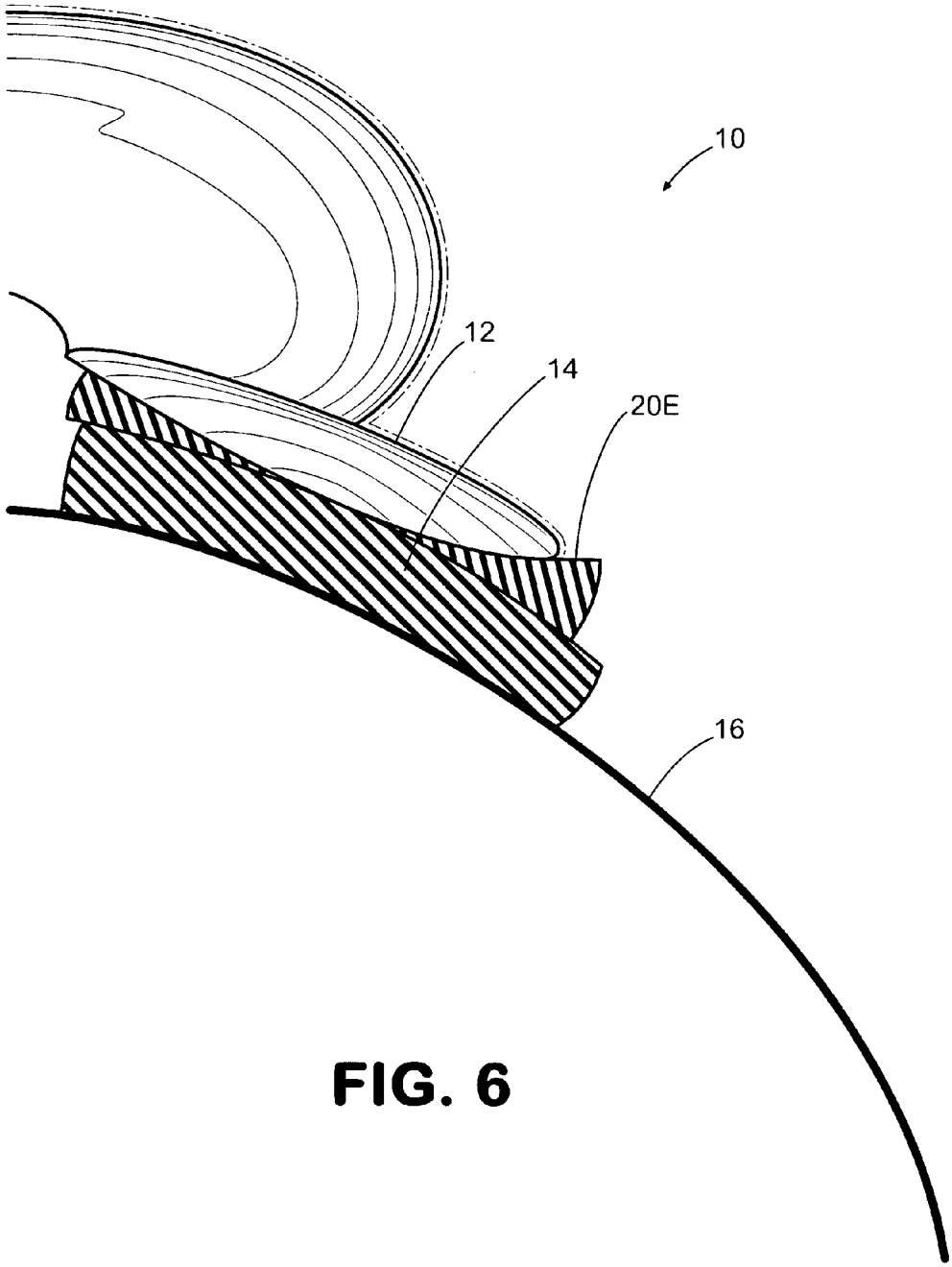
FIG. 6 is a rear view of the saddle tree on a horse with a ⅝ inch neoprene pad installed with a ½ inch wedge-shaped shim.

FIG. 6 is a rear view of a saddle tree with a ⅝ inch neoprene pad installed with ½ inch wedge-shaped shim 20E installed to change the lower angle in order to enhance the neoprene's pad 14 contact along the horse's back 16. This wedge-shaped shim 20E is attached to the underneath side of the saddle tree 12 and to the neoprene pad by a hook and loop fastening systems as well as explained above as to FIGS. 3 and 5.

In another embodiment a riding saddle which incorporates the aforementioned adjustable system on trees whose bars are of varying widths to accommodate various breeds of horses whose range of adjustment may vary according to the maximum size that breed may attain, therefore initially selecting a tree within the range of adjustment that may be necessary to accommodate the minimum and maximum size back and shoulders that characterizes that breed. As such, a riding saddle may be constructed or used whose bars are designed in such a way as to allow maximum freedom of movement of the scapula or shoulder blade of the horse being ridden through the inherent cushioning of the neoprene pads resting against the moving shoulders with a sufficient width to avoid constriction of the shoulder movement.

In still another embodiment, a representative riding saddle is claimed whose fitting system treats padding between rigid tree and horse's back as an integral element of fit and allows sufficient width in between bars to accommodate padding without padding encroaching on necessary width as happens with traditional fit approaches which select a tree to accommodate a given shape of horse's back and then add padding as an afterthought in varying degrees in a condition which makes visual inspection of the fit along the back difficult if not impossible.

Optionally, the riding saddle may further include at least one slot formed near or substantially adjacent to the saddle pommel. The slot will allow the rider to use the present system to make fitting adjustments, and further provides the benefit of providing a cooling or heat transfer process between the bottom of the saddle and the horse's back surface, thereby allowing air to flow through the bottom of the saddle when the horse is being ridden resulting in more comfort for the rider and also resulting in preventing humidity and heat build-up on the horse's back.

In yet another embodiment, a riding saddle is disclosed with allows sufficient space in the slot between the bars through which pass the stirrup leathers suspending the stirrups so that the position of the stirrups may be varied forward or backward to accommodate the preference of the rider. The position of the stirrup leathers is held in place using a set screw inserted into a bushing recessed into underside of the tree bars.

It will be readily apparent that the shims can be of any angle shape or thickness as necessary so that the pressure of the saddle is displaced uniformly across the back of the horse. Shims can be placed in two or more layers and can be angled, flat or various shapes as needed to achieve the objectives.

Of course, those skilled in the art will realize that other applications of the method and apparatus disclosed here but not described in detail still remain with the scope of the present invention.

The present invention may be embodied as an apparatus, a method of manufacture or any combination thereof. Other variations and modifications of the present invention will be apparent to those of ordinary skill in the art, and is not limited except by any claims. The particular values and configurations discussed above can be varied, and are cited to illustrate particular embodiments of the present invention. It is contemplated that the use of the present invention can involve components having different characteristics as long as the principles disclosed herein are followed.

GLOSSARY

10 Horse and saddle tree
12 Saddle tree
14 Neoprene pad
16 Horse
18 Gap
20A & B Wedge-shaped shim
20E ½ inch wedge-shaped shims
22 Soft molding pad
24 Foam pad
26A & B ¼ inch flat shim
28A & B ⅛ inch flat shim
30A & B Hook and loop fastening systems
32A & B ⅛ inch shim
38A & B Hook and loop fastening system
40A, B & C Hook and loop fastening system It should be emphasized that the above-described embodiments of the present invention, particularly, any "preferred" embodiments, are merely possible examples of implementations, merely set forth for a clear understanding of the principles of the invention. Many variations and modifications may be made to the above-described embodiment(s) of the invention without departing substantially from the spirit and principles of the invention. All such modifications and variations are intended to be included herein within the scope of this disclosure and the present invention and protected by the following claims.

Therefore, having thus described the invention, at least the following is claimed:

1. A riding saddle customized to adapt to the contours of the back of a horse so as to distribute the pressure of the saddle on the back of the horse comprising:

a saddle tree, a seat fixed to the tree, said seat having a front attached to a pommel and a back attached to a cantle, said tree consisting of two bars, each of which has an underside, a pad with a top face that extends along the underside of the bars, a plurality of shims interposed between the pad and underside of the bars, each shim having a top and bottom face, said shims being of various sizes, shapes and thickness selected and located to adapt to the contours of a particular horse in order to distribute the pressure of the saddle more uniformly on the back of the horse, said shims being removably secured to the underside of a bar of the tree by a hook and loop fastening system which interconnects the underside of the tree with the top face of the shim, said shims being removably secured to the top face of the pad by a hook and loop fastening system which interconnects the pad and the bottom face of each shim, said hook and loop fastening systems being capable of maintaining the shims in the locations selected on the underside of the saddle when the saddle is on and off of the horse, said shims being easily removable for the placement of shims of different shapes, sizes and thickness selected and located to adapt to the contours of a different horse.

2. The riding saddle of claim 1 in which each hook and loop fastening system has a hook section and a loop section, with each section being integrated into a sheet of material which is attached to the respective face of a shim, pad or underside of a bar.

3. The riding saddle of claim 2 in which the sheet of material with a section is attached to the respective face of a shim, pad or underside of a bar by mechanical fasteners.

4. The riding saddle of claim 3 in which the mechanical fasteners which attach the sheet of material with a section to the underside of a bar are tacks.

5. The riding saddle of claim 3 in which the mechanical fasteners which attach the sheet of material with a section to the underside of a bar are staples.

6. The riding saddle of claim 2 in which the sheet of material with a section is attached to the respective face of a shim, pad or underside of the bar by an adhesive.

7. The riding saddle of claim 2 in which the pad is constructed of neoprene material.

8. The riding saddle of claim 7 in which the neoprene pad is moldable so the pad can conform to the back of a particular horse and maintain its shape.

9. The riding saddle of claim 7 in which the neoprene pad is reboundable so the pad can conform to the backs of different horses and better accommodate the use of shims and, thus uniformly distribute the pressure on the back of each horse on which the saddle is placed.

10. The riding saddle of claim 2 in which there are at least two layers of shims between the underside of the bars and pad in at least one area between the pad and the underside of the bars with each layer of shims being removably attached to any adjoining layer of shims by a hook and loop fastening system.

11. The riding saddle of claim 1 in which the pad is constructed of neoprene material.

12. The riding saddle of claim 11 in which the neoprene pad is moldable so the pad can conform to the back of a particular horse and maintains its shape.

13. The riding saddle of claim 11 in which the neoprene pad is reboundable so the pad can conform to the backs of different horses and better accommodate the use of shims and, thus uniformly distribute the pressure on the back of each horse on which the saddle is placed.

14. The riding saddle of claim 1 in which there are at least two layers of shims between the underside of the bars and pad in at least one area between the pad and the underside of the bars as required to fill voids with each layer of shims being removably attached to any adjoining layer of shims by a hook and loop fastening system.

15. A method of customized fitting a saddle having a tree with two bars, with each bar having an underside, said method adjusting the fit of the saddle to adapt to the contours of the back of a horse so as to more uniformly distribute the pressure of the saddle on the back of the horse comprising:

attaching a sheet of material which has an integrated section of a hook and loop fastening system to the underside of the bars of the saddle tree;

selecting a plurality of shims, with each shim having a top and bottom face, said shims being of various sizes, shapes and thickness selected and located to adapt to the contours of a particular horse in order to distribute the pressure of the saddle more uniformly on the back of the horse, with the top face of each shim having another section of a hook and loop fastening system that make the system between the shim and the underside of the bars of the saddle tree complete when the hooks and loops are engaged which interconnects the underside of the bars and the top face of each shim;

selecting a pad of the desired flexibility, said pad having a top face having a section of a hook and loop fastening system, with the bottom face of each shim having another section of a hook and loop fastening system that makes the fastening system complete when the hooks and loops are engaged which interconnects the shims and the pad;

positioning the shims and pad in the desired location in relation to the bars of the saddle tree and engaging each of the hook and loop fastening systems to interconnect the pad and shims to the underside of the bars of the saddle, said hook and loop fastening systems being capable of maintaining the shims and pad in the location selected on the underside of the saddle when on and off of the horse, said shims and pad being easily removable for the placement of shims of different shapes, sizes and thickness selected and located to adapt to the contours of a different horse.

16. The method of claim 15 in which each hook and loop fastening system has a hook section and a loop section, with each section being integrated into a sheet of material which is attached to the respective face of a shim, pad or underside of a bar.

17. The method of 15 in which the pad is constructed of neoprene material.

18. The method of claim 17 in which the neoprene pad is moldable so the pad can conform to the back of a particular horse and maintain its shape.

19. The method of claim 17 in which the neoprene pad is reboundable so the pad can conform to the backs of different horses and uniformly distribute the pressure on the back of each horse on which a saddle is placed.

20. The method of claim 15 which comprises the further steps of placing the saddle with the pad and shims on the back of a horse and checking for a proper fitting and removing and making any adjustment in the size, shape and thickness of the shims that is necessary and again placing the saddle upon the back of the horse until a proper fit is obtained.

* * * * *